US005540074A

United States Patent [19]

Smith et al.

[11] Patent Number: 5,540,074

[45] Date of Patent: Jul. 30, 1996

[54] UNITARY ASSEMBLY OF PERIPHERAL DEVICES FOR USE WITH STECKEL MILL

[75] Inventors: Olan R. Smith; Michael J. Suchan, both of Regina, Canada

[73] Assignee: IPSCO Enterprises Inc., Wilmington, Del.

[21] Appl. No.: 350,804

[22] Filed: Dec. 7, 1994

[51] Int. Cl.[6] ..... B21B 45/06

[52] U.S. Cl. ..... 72/39; 72/201; 72/229; 72/10; 72/12.7; 134/122 R

[58] Field of Search ..... 72/39, 40, 43, 72/201, 229, 10, 12; 29/81.08; 134/15, 64 R, 95.3, 122 R, 198, 199

[56] References Cited

U.S. PATENT DOCUMENTS

| | | | |
|---|---|---|---|
| 1,455,278 | 5/1923 | Sundh | 134/64 R |
| 2,900,991 | 8/1959 | Arnold | 134/64 R |
| 3,938,214 | 2/1976 | Hodsen et al. | 134/64 R |
| 4,584,746 | 4/1986 | Tivolle et al. | 29/81.08 |
| 4,675,974 | 6/1987 | Connolly | 72/229 |

*Primary Examiner*—Lowell A. Larson
*Assistant Examiner*—Thomas C. Schoeffler
*Attorney, Agent, or Firm*—Robert H. Barrigar; Barrigar & Moss

[57] ABSTRACT

A self-contained unitary assembly for peripheral devices normally located close to a Steckel mill is provided. The assembly has a frame open at both ends to receive and pass through the steel product being rolled. Above and below the pathway for the steel product are located transversely spaced arrays of descaler nozzles and their headers and also controlled cooling nozzles and their headers. Also included within the unitary assembly is the x-ray measuring gauge or other suitable measuring instrument for measuring some characteristic of the steel product. The unitary assembly is positioned between the pinch rolls and the Steckel mill. Protective steel plates or beams are provided running both transversely and longitudinally within the frame for the assembly to provide protection for the nozzles and measuring apparatus. These protective elements also serve to minimize the amount of errant water spray that might otherwise tend to enter the coiler furnace.

8 Claims, 3 Drawing Sheets

UNITARY ASSEMBLY OF PERIPHERAL DEVICES FOR USE WITH STECKEL MILL

This invention relates to a protected assembly of enclosed peripheral devices for use with a Steckel mill.

BACKGROUND OF THE INVENTION

Reversing rolling mills (hereinafter referred to as "Steckel mills") for use in the rolling of steel require peripheral equipment to be located on either side of the Steckel mill. Conventionally included in the peripheral equipment is a pair of pinch rolls to advance the leading edge of the strip of steel being rolled into the bite or kissing point of the reduction rolls, a descaler, and thickness and profile gauges (typically x-ray gauges). Frequently, only a thickness gauge is provided upstream of the Steckel mill, whilst both thickness and profile gauges are provided on the downstream side of the Steckel mill. These gauges measure the thickness or profile of the strip being rolled for the purpose of providing feedback to govern the rolling operation, and to ensure that the strip being rolled will meet customer specifications.

Heretofore, it has been the conventional practice to design and install each of these peripheral devices as an independently designed and installed device.

Partly because of the reversing characteristic of a Steckel mill requiring a strip to be moved alternately in upstream and downstream directions through the Steckel mill, and partly because of the inherent risk of an unruly rogue steel strip, the smaller peripheral equipment is subject to damage. Further, in order to reduce the heat loss of the strip being rolled, the coiler furnace should be located as close as possible to the Steckel mill, yet it is necessary to make room for all of the items of peripheral equipment mentioned and sometimes other items (e.g. an edger) between the coiler furnace and the Steckel mill, so longitudinal space along the length of the rolling line next to the Steckel mill is at a premium.

Consequently, for the foregoing reasons, mill designers prefer to keep to a minimum the number of peripheral devices located between the Steckel mill and the coiler furnace on either side of the Steckel mill, and to attempt to make some of the peripheral units do double duty where possible. Thus, for example, the descaler could be used to provide a cooling water spray of the sort that would normally be applied relatively gently over a relatively large surface area of the steel being rolled for the obtention of preferred metallurgical properties. This is in contrast to the normal operation of a descaler unit, which provides a concentrated high-pressure spray for the purpose of knocking scale off the strip being rolled. Requiring the descaler nozzles to do double duty saves space, but at the expense of quality of product.

SUMMARY OF THE INVENTION

The invention is an enclosed protected multi-purpose assembly of peripheral devices for use with a Steckel mill. The assembly is positioned between the pinch rolls and the Steckel mill on either side of the Steckel mill, and includes at least one strip measuring gauge, descaler nozzles, and controlled cooling spray nozzles, the nozzles, of course, being connectable to suitable water supply headers. Protective structural steel barriers are preferably mounted adjacent the nozzles and the measuring device to protect them from damage.

Desirably, the measuring gauges are arranged as modular devices transversely removable from the assembly.

Desirably, the measuring devices are located as close as possible to the Steckel mill reduction rolls so that readings of the steel strip thickness and profile can be taken immediately before and immediately after entry of the steel strip through the reduction rolls of the Steckel mill.

Desirably, the frame for the assembly is immediately adjacent the frame in which the pinch rolls are mounted, the pinch roll frame itself serving as a protector for the more fragile peripheral elements within the assembly, and also optionally serving as an auxiliary frame on which to mount some of the protective barriers for the peripheral devices. Further, the steel strip is usually under control (i.e., not unruly) as it passes through the pinch rolls. The fact that the steel strip is constrained in its movement by the pinch rolls, itself affords a measure of protection for the peripheral units located immediately adjacent the pinch rolls.

This unitary design approach permits all of the aforementioned peripheral devices to be located closely together as parts of a single integrated design and, because of this, tends to free up enough space (as compared with conventional designs) that an array of controlled cooling spray nozzles can be included within the assembly without taking up additional rolling-line space (as compared with conventional designs), thereby permitting controlled cooling spray nozzles to be used in lieu of descaler nozzles for the obtention of preferred metallurgical properties of the steel strip passing through the unit.

DETAILED DESCRIPTION WITH REFERENCE TO THE DRAWINGS

Figure 1:
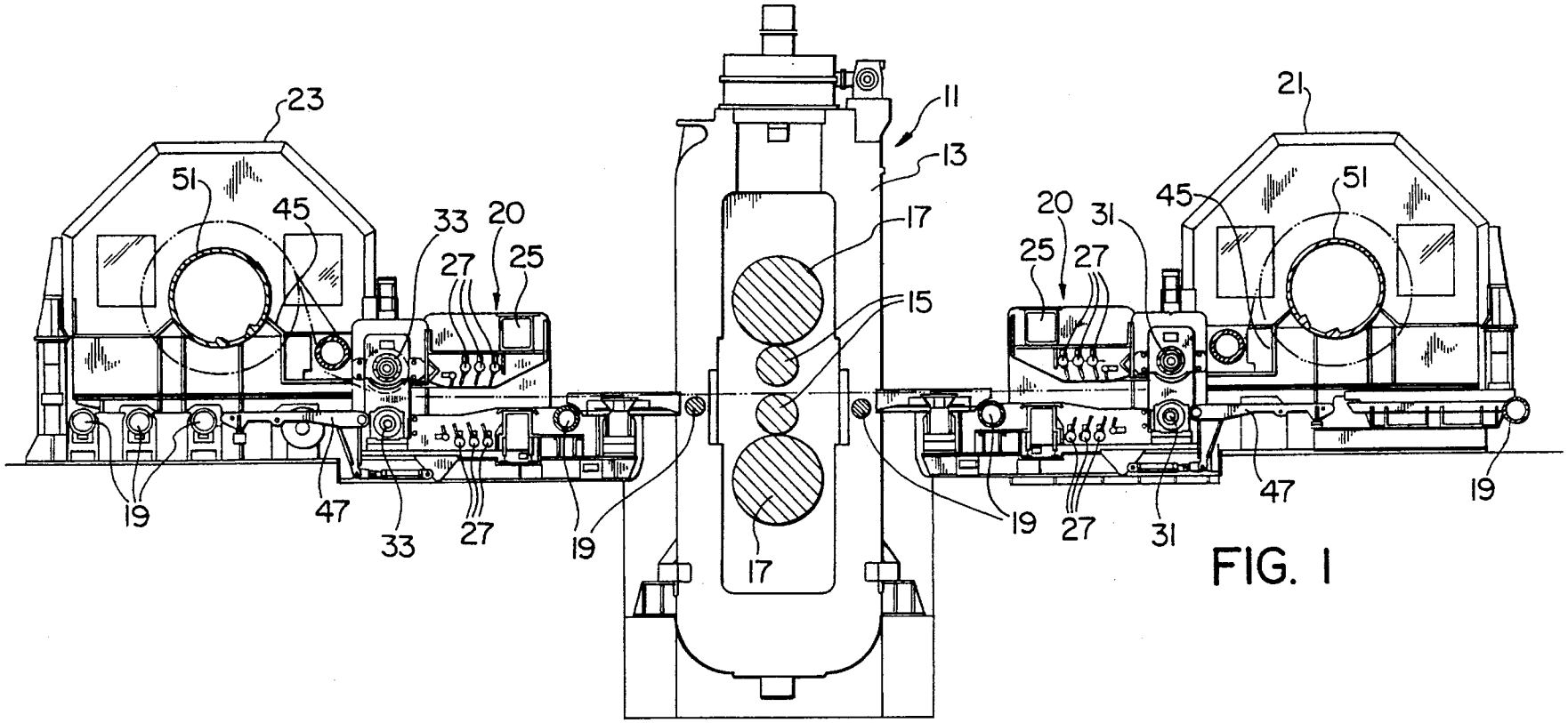
FIG. 1 is a schematic elevation view of a Steckel mill and coiler furnace arrangement having an exemplary unitary peripheral assembly constructed in accordance with the present invention placed on either side of the Steckel mill.
Figure 2:
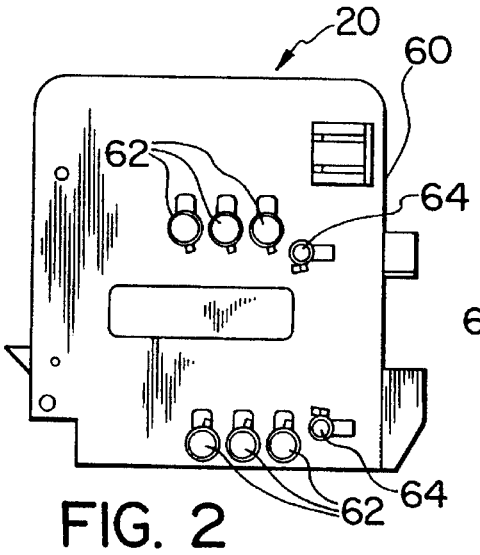
FIG. 2 is a side elevation view of the unitary assembly of FIG. 1 constructed in accordance with the present invention.
Figure 3:
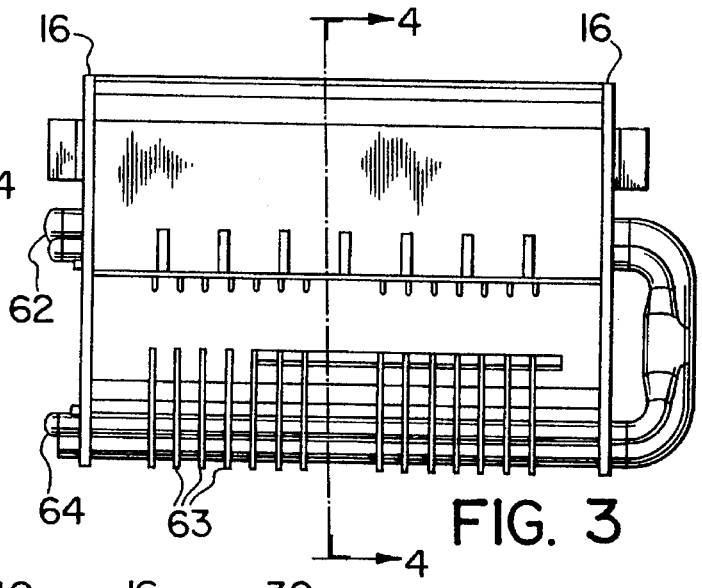
FIG. 3 is an end elevation view of the assembly of FIG. 2, partly in section.

The apparatus shown in FIG. 1 includes a Steckel mill generally indicated as 11, provided with a frame 13 in which a pair of reducing work rolls 15 and associated back-up rolls 17 are rotatably mounted. Table rolls 19 positioned as required drivingly support the slab or strip of steel being rolled, both upstream and downstream of the Steckel mill.

An upstream coiler furnace 21 and a downstream coiler furnace 23 are located immediately upstream and immediately downstream respectively of the Steckel mill 11 within the limits imposed by the need to interpose some equipment between the Steckel mill 11 and each of the coiler furnaces 21 and 23. Illustrated by way of example are x-ray gauges 25, spray nozzles 27, and pinch rolls, the upstream pair of pinch rolls being designated as 31 and the downstream pair designated as 33.

Rotatably mounted within coiler furnaces 21, 23 are winding drums 51 for the steel strip, which is guided into engagement with a drum 51 by means of a suitable conventional pivoting guide (not shown). Fixed upper shields 45 and pivoting lower gate extensions 47 are arranged to span as much as possible of the distance between the coiler furnaces 21, 23 and the pinch rolls 31, 33 respectively.

In operation, a strip of steel from the upstream side of the Steckel mill 11 enters the bite between reduction rolls 15, is reduced in thickness and, if sufficiently thin, is then directed via pinch rolls 33, gate extension 47, and guide 49 into engagement with drum 51 within coiler furnace 23, whereupon the strip is wound up on the drum 51.

This procedure is reversed when the coil of strip steel is paid out of coiler furnace 23, reduced by Steckel mill 11, and wound up into coiler furnace 21.

The apparatus shown in FIGS. 2 through 6 is an exemplary unitary peripheral assembly 20 that is located upstream of the Steckel mill 11 between the Steckel mill 11 and the upstream coiler furnace 21. A very similar mirror-image arrangement of what is illustrated in FIGS. 2–6 will be found on the downstream side of the Steckel mill 11 between the Steckel mill 11 and the downstream coiler furnace 23. On the downstream side of the Steckel mill 11, there may be some other peripheral equipment required.

Figure 4:
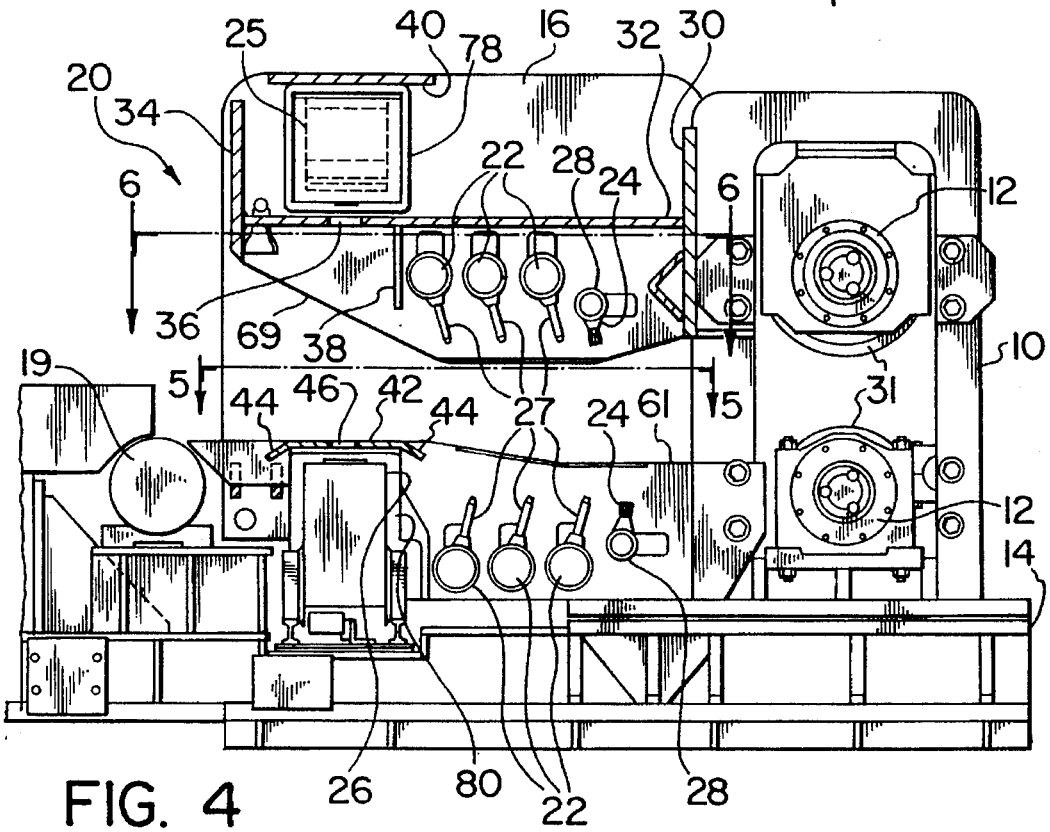
FIG. 4 is a section view of the assembly of FIGS. 2 and 3 taken along the line 4—4 of FIG. 3.
Figure 5:
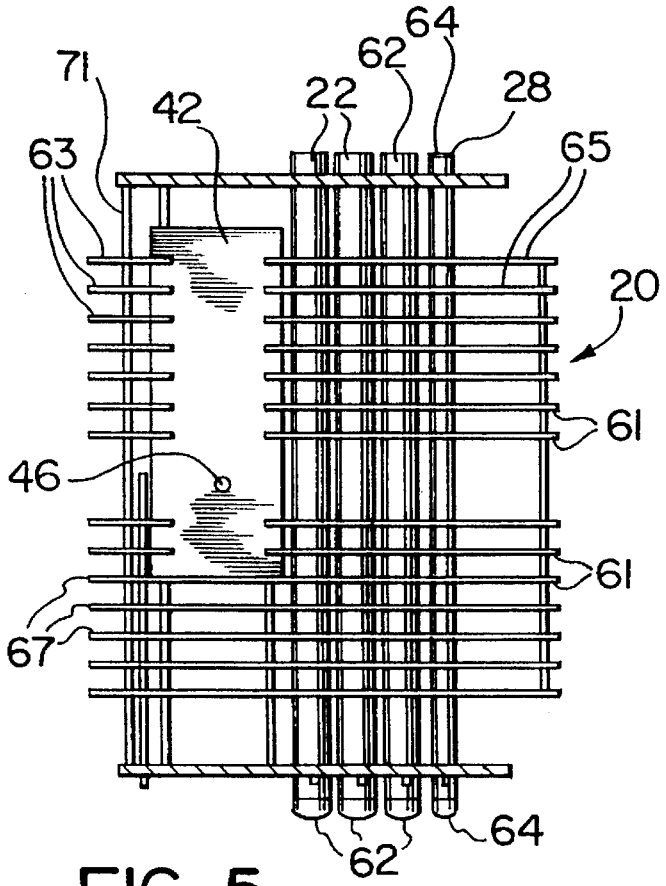
FIG. 5 is a section view of the assembly of FIG. 2, taken along line 5—5 of FIG. 4.
Figure 6:
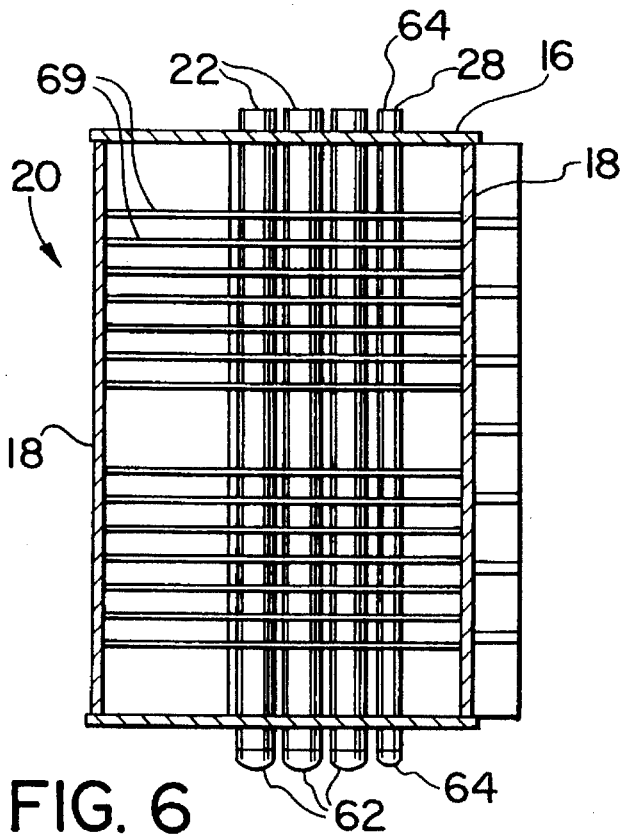
FIG. 6 is a section view of the assembly of FIG. 2, taken along line 6—6 of FIG. 4, but not including what is particular to FIG. 5.

Note that FIG. 4 illustrates the combination of the unitary assembly 20 and the pinch roll assembly 10 in which pinch rolls 31 are mounted, illustrating contiguous and overlapping frame elements. However, the pinch roll assembly 10 is not illustrated in FIGS. 2, 3, 5 and 6.

Referring now in detail to FIGS. 2 to 6, a frame 10 for pinch rolls 31 journalled in end bearing assemblies 12 is mounted on an underlying support frame 14. A conventional mechanism (not shown) is provided to adjust the bite between the pinch rolls 31 according to the thickness of the steel strip passed between the pinch rolls 31. The support frame 14 and pinch roll frame 10 may also serve to support structural elements of unitary assembly 20, which is located immediately downstream of the pinch roll frame 10, and preferably continuous therewith. Unitary assembly 20 comprises side walls 16 and transverse end beams 18 (FIG. 6) forming a frame about the following peripheral units:

(i) an upper x-ray gauge assembly 25 and mating lower x-ray gauge assembly 26 located within protective x-ray gauge housings 78, 80 respectively;

(ii) a spaced array (longitudinally and transversely) of upper and lower controlled cooling nozzles 27 supplied by associated water supply headers (conduits) 22; and (iii) a transversely aligned and spaced upper and lower descaler nozzles 24, to which high-pressure water is supplied via associated water supply headers (conduits) 28.

Note that the interior space of the unitary assembly 20 is open, thus providing an unobstructed pathway within the peripheral unit assembly 20 through which the steel product being rolled may pass.

The various nozzles 24 and 27, and the water supply headers 22 and 28 associated with them, are suitably supported by side walls 16 of the frame. Obviously, enough space must be provided between the upper and lower sets of nozzles 27 and 24 to permit the steel strip being rolled to pass therebetween.

Should a rogue of sheet steel happen to collide with any of the constituent devices within the unitary assembly 20, considerable and perhaps irreparable damage to them could ensue. Consequently, to protect the interior peripheral elements, suitable structural steel barriers are fixed in position. In particular, a vertical transverse barrier support plate or beam 30 (FIG. 4) affixed to the downstream end of pinch roll frame 10 supports a horizontal protective plate 32 stretching across the entire longitudinal length of the frame side walls 16 and terminating in an upper end vertical transverse protector plate 34 that protects X-ray gauge 25. The vertical protective barrier 34 is also fixed to and supported by side frame element 16 that in turn is supported by and projects upwardly from underlying support frame 14. A suitable cavity 36 is provided in plate 32 to permit an x-ray beam to pass freely between upper and lower x-ray gauge units 25, 26. The horizontal plate 32 provides rigid support for end plate 34.

Downwardly projecting from horizontal protective plate 32 is an auxiliary vertical transverse protective beam 38 immediately downstream of the most downstream controlled cooling nozzle 27 and associated water supply header 22.

Horizontal protective plates 40, 42 are located immediately above x-ray gauge units 25, 26 respectively. The protective plate 42 may be provided with angled edge portions 44 to provide further protection for the lower x-ray gauge unit 26. Centrally located within the protective plate 42 is an aperture 46 to permit the x-ray beam to pass freely between upper and lower x-ray gauge units 25, 26. Plates 32, 38, 40 and 42 are all suitably affixed to and supported by side frame elements 16.

For the purpose of further shielding and protecting the nozzles 24, 27, x-ray gauge devices 25, 26 and any other relatively fragile elements within the unitary assembly 20, a series of horizontal and vertical baffle plates or aprons or deflectors are provided. (The term "deflector" tends to be used for those plates lying above the path of travel of the steel strip, and the term "apron" tends to be used for those plates lying below the path of travel of the steel strip.) These include the horizontal transverse plate 42 already mentioned, vertical longitudinally oriented aprons 61 (some of which have longer portions 65 and shorter portions 63 between which is mounted the horizontal plate 42), and vertical longitudinally oriented deflector 69. Exemplary ones of each of these vertical aprons and deflectors have been identified by the associated reference numerals, but it is to be understood that an array of about a dozen or more such vertical plates may be present in order to provide protection for the various operating elements (such as the nozzles 27 and x-ray gauges 25, 26). Each of the vertical aprons and deflectors 61, 69 is transversely spaced apart from its neighbor transversely sufficiently to enable nozzles 24, 27 or other pieces of equipment to be placed therebetween. The nozzles 24, 27 are thus seen to be occluded or shrouded by the apron and deflector plates 61, 69 so that they are protected from collision with a rogue strip of steel being rolled. Such collision will tend not to destroy the nozzle arrangement (etc.) but instead, the rogue strip will tend to be deflected by the aprons and deflector plates 61, 69. The plates 61, 69 are supported by suitable transverse support plates or beams such as the support plates 18 and 71 of FIGS. 5 and 6.

The side walls 16 of unitary assembly 20 define the side edges of the assembly 20 beyond which the ends 62 of cooling water headers 22 project and ends 64 of descaler supply headers 28 project.

Preferably the x-ray units 25 and 26 are located as close as possible to the Steckel mill 11 so that measurement of the steel strip thickness or profile, as the case may be, can be obtained as close as possible to the reduction rolls 15 of the Steckel mill 11. The descaler nozzles 24 should preferably be located closer to the coiler furnace than the other peripheral devices within assembly 16 in order that scale be removed well before the steel strip reaches the Steckel mill 11. The cooling nozzles 27 should operate on descaled plate, and the x-ray gauges 25, 26 should measure descaled strip, so both the cooling nozzles 27 and the x-ray gauge units 25, 26 should be located between the Steckel mill 11 and the descaler nozzles 24. This preferred spatial sequence tends to determine the arrangement of peripheral units within assembly 20. Note that the descaler nozzles 24 and cooling nozzles 27 do not both operate simultaneously.

Again, because the x-ray gauge units 25, 26 should be positioned as close as possible to the Steckel mill 11, it follows that the pinch rolls 31 and associated frame 10 should be located between the peripheral unit assembly 16 and the coiler furnace 21, rather than between the peripheral unit assembly 16 and the Steckel mill 11. Furthermore, it is desirable that the steel strip be constrained from movement both upstream and downstream of the relatively fragile peripheral elements, and this is possible when the strip is constrained on one end of the peripheral unit assembly 16 by the Steckel mill reduction rolls 15 and on the other side of the peripheral units by the pinch rolls 31. These considerations dictate the positioning of the pinch roll frame 10 between the coiler furnace and the fragile peripheral units. The pinch rolls 31 also determine the vertical position of the strip being rolled and constrain it within a predetermined path of travel.

The unitary assembly 20, with its protective plates and frame elements, also inhibits unfocussed water spray, thereby tending (desirably) to minimize the amount of water tending to enter the coiler furnace.

Variants of the foregoing will readily occur to those skilled in the technology. The scope of the invention is as defined in the appended claims.

What is claimed is:

1. In combination, a Steckel mill for the rolling of a steel product, and a self-contained peripheral unit assembly comprising a frame having an open unobstructed interior passageway between upstream and downstream ends thereof to provide a pathway for the steel product being rolled, and having fixed to the frame the following peripheral units:

(i) a transverse array of upper and lower descaler nozzles and associated high-pressure water supply headers for supplying water to the descaler nozzles positioned within the frame above and below the pathway for the steel product in the vicinity of one end of the frame;

(ii) measuring apparatus for measurement of at least one characteristic of the steel product; said measuring apparatus being positioned within the frame outside the pathway for the steel product in the vicinity of that end of the frame remote from the end of the frame in the vicinity of which the descaling nozzles are located;

(iii) a transverse array of upper and lower controlled cooling nozzles and associated water supply headers for supplying water thereto positioned within the frame above and below the pathway for the steel product through the frame and between the measuring apparatus and the descaler nozzles.

2. The combination defined in claim 1, additionally comprising protective structural steel barriers within the frame for protection of the nozzles and measuring apparatus.

3. The combination defined in claim 2, wherein the barriers include generally vertically transverse structural steel plates between the measuring apparatus and a wall of the frame proximate to the measuring apparatus, a protective transverse barrier for protecting the array of controlled cooling nozzles located above the pathway for the steel product through the frame and at the end of the array of the controlled cooling nozzles nearest the end of the frame at which the measuring apparatus is located.

4. The combination defined in claim 3, additionally comprising at least one generally horizontal protective element disposed immediately adjacent the measuring apparatus.

5. The combination defined in claim 1, additionally comprising at least one generally horizontal protective element fixed to and within the frame and disposed immediately adjacent the measuring apparatus.

6. The combination defined in claim 1, additionally comprising a pinch roller support frame fixed to the assembly frame at the end thereof nearest the array of descaler nozzles.

7. The combination defined in claim 1, additionally comprising generally horizontal protective elements fixed to and within the frame and disposed immediately adjacent the measuring apparatus for the protection of the measuring apparatus.

8. The combination defined in claim 7, wherein the support frame for the pinch rolls also provides support for selected ones of the protective elements within the frame for the peripheral elements located above the patch of travel of the steel product through the frame.

* * * * *

UNITED STATES PATENT AND TRADEMARK OFFICE

CERTIFICATE OF CORRECTION

PATENT NO. : 5,540,074
DATED : July 30, 1996
INVENTOR(S) : Olan R. Smith, et. al.

It is certified that error appears in the above-indentified patent and that said Letters Patent is hereby corrected as shown below:

Col. 3, line 40, delete "continuous" and insert --contiguous--.

Col. 6, line 44, delete "patch" and insert --path--.

Signed and Sealed this

Nineteenth Day of November, 1996

*Attest:*

Bruce Lehman

BRUCE LEHMAN

*Attesting Officer*

*Commissioner of Patents and Trademarks*